United States Patent [19]

Forsberg

[11] 4,102,263

[45] Jul. 25, 1978

[54] GARBAGE RECYCLING SYSTEM

[76] Inventor: Robin R. Forsberg, 898 McGlincy La., Campbell, Calif. 95008

[21] Appl. No.: 821,449

[22] Filed: Aug. 3, 1977

[51] Int. Cl.[2] ..... B30B 15/30

[52] U.S. Cl. ..... 100/74; 100/99; 100/102; 100/127; 241/44; 241/99

[58] Field of Search ..... 100/DIG. 2, 73, 74, 100/75, 94, 95, 96, 97, 102, 126, 127, 250; 241/42, 44, 99, 100, 134; 134/63

[56] References Cited

U.S. PATENT DOCUMENTS

| | | | |
|---|---|---|---|
| 533,018 | 1/1895 | Prince | 241/100 |
| 692,605 | 2/1902 | Bratton | 100/95 |
| 929,960 | 8/1909 | Low | 100/95 |
| 3,703,970 | 11/1972 | Benson | 241/100 |
| 3,926,379 | 12/1975 | Dryden | 241/100 |

*Primary Examiner*—Billy J. Wilhite
*Attorney, Agent, or Firm*—Robert K. Rhea

[57] ABSTRACT

A device for reducing solid waste material to a comminuted and/or compacted state for ease in disposal. The device comprises a series of receptacles, one for each class of waste material, provided with power driven cutters. At least one hydraulic ram type compactor compresses waste material.

1 Claim, 2 Drawing Figures

GARBAGE RECYCLING SYSTEM

CROSS REFERENCE TO RELATED APPLICATION

This application is a substitute of an application filed by me in the United States Patent and Trademark Office on Nov. 17, 1975, Ser. No. 632,875 for Garbage Recycling System, now abandoned.

BACKGROUND OF THE INVENTION

1. Field of the Invention.

The present invention relates to an apparatus for the disposal of solid waste material and more particularly to a device for recycling the waste material.

It is present practice to dispose of household solid waste material by placing such material in cans which are picked up and emptied into a refuse or garbage truck for disposal in a selected site which is usually covered by soil. Such disposal sites, commonly known as "land fills", requires a constant search for additional suitable disposal sites and has the disadvantage that the earth covered material does not readily decompose, particularly when some of the refuse is metallic objects, such as tin cans, or the like.

This invention provides an apparatus which reduces the bulk of substantially all household refuse or garbage and compacts it for use in a manner known as recycling.

2. Description of the Prior Art.

Prior patents, such as U.S. Pat. Nos. 929,960 and 3,703,970, have generally related to apparatus for shredding and compacting waste material which breaks up such waste into small particles and compacts it for disposal or for forming fertilizer material, such as disclosed by U.S. Pat. No. 533,108. Other patents disclose apparatus for detinning cans, or the like, to recover the tin content for reuse rather than compacting the tin cans for such use or for use in a smelter which is a feature of this invention in addition to shredding household refuse or garbage for recycling.

SUMMARY OF THE INVENTION

A plurality of juxtaposed upwardly open receptacles, one for each class of solid waste material to be disposed of, are provided with individual containers or bins for receiving the material deposited therein. The waste material, which may be cut, shredded or broken up is comminuted by cutters, or the like, within the respective receptacle with the cutters being motor driven. That material which can be compacted, such as paper products or tin cans, is received by a mold forming press wherein a ram compacts the material. Other material, such as glass, is deposited in a bin disposed below the receiving receptacle for periodic removal. Fluid chemical is sprayed on the waste paper products while being shredded as a preservative, insect repellent and compactive additive.

The principal object of this invention is to provide an apparatus for reducing the bulk of garbage, or the like, and placing it in a compacted condition for removal to a recycling point.

DESCRIPTION OF THE PREFERRED EMBODIMENT

Figure 1:
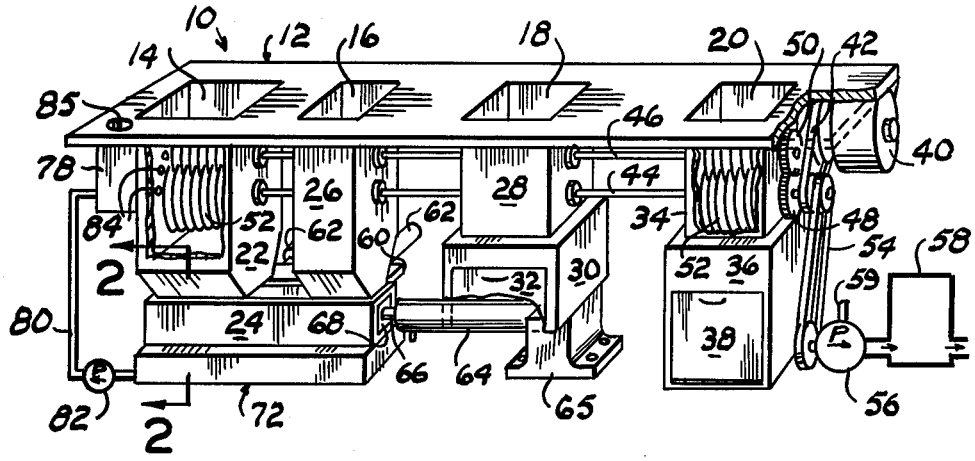
FIG. 1 is a perspective view of the apparatus with parts broken away for clarity; and, FIG. 2 is a fragmentary vertical cross sectional view, to a larger scale, partially in elevation, taken substantially along the line 2—2 of FIG. 1.
Figure 2:
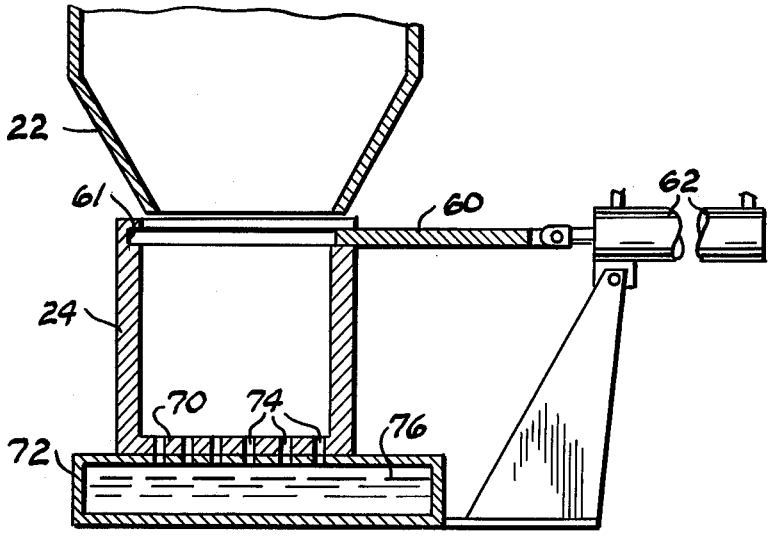

Like characters of reference designate like parts in those figures of the drawings in which they occur.

In the drawings:

The reference numeral 10 indicates the apparatus, as a whole, which is substantially rectangular in general configuration. The device 10 comprises a horizontal platform-like top 12 having a plurality of longitudinally spaced openings 14, 16, 18 and 20. The waste paper receiving opening 14 communicates with an upwardly open receptacle 22 depending from the top 12 which empties into one end portion of a horizontally disposed elongated rectangular hydraulic press type mold 24 to be described later in more detail.

The tin can receiving opening 16 communicates with a similar depending receptacle 26 having its bottom open to the other end portion of the mold 24. The glass receiving opening 18 similarly communicates with a receptacle 28 depending from the platform 12 with the bottom of the receptacle communicating with a box-like bin or container 30 having an access door 32.

The waste plastic material receiving opening 20 similarly communicates with a receptacle 34 similarly mounted on a rectangular receptacle 36 provided with an access door 38. A suitable motor 40, having a belt and pulleys 42, drives an elongated shaft 44 extending through and journalled by the receptacles 22, 26, 28 and 34. A similar shaft 46, parallel with the driven shaft 44, extends through and is journalled by the respective receptacles.

A gear 48, coaxially mounted on the driven shaft 44, meshes with a spur gear 50 similarly mounted on the shaft 46, for rotating the shaft 46.

Suitable cutters 52 are mounted on the respective shafts 44 and 46 within the receptacles 22 and 34 for shredding bulky material deposited in the openings 14 and 20, respectively. Similar cutters or glass breakers, not shown, are mounted on the shafts 44 and 46 within the receptacle 28.

Other belt and pulley means 54, connected with the motor driven shaft 44 and a hydraulic pump 56, supplies hydraulic fluid to an accumulator 58, for the purposes presently explained. The hydraulic pump is connected in a conventional manner with a hydraulic fluid reservoir, not shown, by a line 59.

The mold 24 is substantially square in transverse section and is provided with a laterally movable cover 60 sliding in grooves 61 which is moved to a mold open or closed position by a plurality of double action hydraulic cylinders 62 connected with the accumulator 58 by hydraulic lines and control valves, not shown.

A double acting ram 64 has its piston rod 66 connected with a block 68 longitudinally slidable within the mold 24. The opposite end of the ram abuts and is supported by a stop 65 underlying the bin 30. The ram is similarly connected with the accumulator 58. The bottom wall 70 of the mold overlies a tank-like reservoir 72 and is provided with a plurality of apertures 74 forming drain holes communicating with the reservoir 72, for the reasons presently explained.

The reservoir 72 contains a quantity of liquid chemical 76 to be sprayed on paper products deposited in the opening 14. The chemical is of the type commonly used in forming simulated fireplace logs so that the compacted paper products may be burned in a fireplace, or the like. The chemical 76 may contain an insect repellent, when desired. A liquid pressure tank 78, supported by the platform 12 adjacent the receptacle 22, is connected with the reservoir 72 by tubing 80 having a pump 82 and a filter, now shown, interposed in the tubing for supplying the chemical 76 under pressure to the tank 78 and exhausting the chemical into the receptacle 22 through nozzles 84 projecting through the adjacent wall of the receptacle 22 to spray paper products while being processed by the cutters 52.

OPERATION

In operation, the mold lid 60 is retracted to a mold open position as shown by solid lines. The motor 40 is started and paper products are deposited in the receptacle 22 through the opening 14 so that the cutters 52 shred or cut up the paper material. During this time the pump 82 is spraying the paper products with the chemical 76. After the paper products have fallen, by gravity, into the mold 24, the cylinders 62 are actuated to close the mold lid 60. The ram 62 is actuated to compress the paper products. Chemical squeezed out of the paper products during the compressing action returns, by gravity, to the reservoir 72 for reuse. The supply of chemical 76 is replenished through an opening 85 in the top 12 communicating with the tank 78. The end wall of the mold 24, opposite the ram 64, is preferably provided with hinge and clamp means, not shown, for removing the resulting compacted paper products.

Tin cans, or the like, not shown, deposited in the receptacle 26 through the opening 16 fall, by gravity, into the mold 24 and are similarly compacted by the ram 64 to form ingots for use in a smelter, or the like.

Glass deposited in the receptacle 28 and plastic containers deposited in the receptacle 34 through their respective openings 18 and 20 are removed through the access doors 32 and 28, respectively.

An additional similar unit may be added as, for example, between the receptacles 22 and 26, for processing waste foods to be compacted into block form and used for composting or soil mulch.

Obviously the invention is susceptible to changes or alterations without defeating its practicability. Therefore, I do not wish to be confined to the preferred embodiment shown in the drawings and described herein.

I claim:

1. Apparatus for treating garbage, comprising:

a receptacle having an open bottom and having an open upper end forming a passageway for receiving and passing garbage;

shredder means including a motor driven shredder disposed transversely of the receptacle passageway for acting on garbage and reducing its bulk when garbage is placed within said receptacle;

container means including a mold having a cover for opening and closing the mold disposed below said receptacle for receiving garbage falling by gravity through said receptacle;

a ram operatively connected with said mold for compacting garbage therein;

a reservoir underlying said mold;

a liquid within said reservoir, said mold and said reservoir having cooperating apertures formed in at least one wall providing liquid communication between said mold and said reservoir;

a pressure tank disposed adjacent said receptacle;

a plurality of nozzles providing liquid communication between said pressure tank and said receptacle; and, pump and tubing means connecting said tank with said reservoir for spraying garbage deposited in said receptacle.

* * * * *